US009829264B1

(12) United States Patent
Berglund

(10) Patent No.: US 9,829,264 B1
(45) Date of Patent: Nov. 28, 2017

(54) MODULAR SOUND SUPPRESSING DEVICE FOR USE WITH FIREARMS

(71) Applicant: Bruce Berglund, Centennial, CO (US)

(72) Inventor: Bruce Berglund, Centennial, CO (US)

( * ) Notice: Subject to any disclaimer, the term of this patent is extended or adjusted under 35 U.S.C. 154(b) by 0 days.

(21) Appl. No.: 15/476,425

(22) Filed: Mar. 31, 2017

(51) Int. Cl.
*F41A 21/30* (2006.01)
*F41A 21/34* (2006.01)

(52) U.S. Cl.
CPC ..... *F41A 21/30* (2013.01); *F41A 21/34* (2013.01)

(58) Field of Classification Search
CPC ..... F41A 21/30
USPC ..... 89/14.4
See application file for complete search history.

(56) References Cited

U.S. PATENT DOCUMENTS 4,530,417 A * 7/1985 Daniel ..... F41A 21/30 181/223
5,136,923 A * 8/1992 Walsh, Jr. ..... F41A 21/30 89/14.2
2013/0312592 A1* 11/2013 Storrs ..... F01N 3/02 89/14.1

* cited by examiner

*Primary Examiner* — J. Woodrow Eldred

(57) ABSTRACT

A suppressor for firearms, comprising a casing, a first hollow diffuser tube having a first end and a second end, wherein the second end is threaded, an upstream disk, wherein the disk has a centric opening that is threaded to mate with the second end of the first diffuser tube and has a thickness that is less than the length of the second end of the first diffuser tube that is threaded and has an external diameter to securely fit within the elongated hollow member, a second hollow diffuser tube having a first end and a second end, an end cap having a centric opening that is threaded to mate with the second end of the second hollow diffuser tube and has an external diameter to securely fit within the second end of the elongated hollow member.

16 Claims, 21 Drawing Sheets

MODULAR SOUND SUPPRESSING DEVICE FOR USE WITH FIREARMS

BACKGROUND OF THE INVENTION

The application relates to sound suppression in firearms, handguns, and rifles, and more particularly to a multi-chamber sound suppression device.

Most suppressors/silencers are attached to the muzzle of a firearm and use a series of baffles inside a tubular outer shell to achieve reduced muzzle sound and flash. These designs attempt to use baffles as a means to slow and allow to cool the hot discharge gasses and combustion products produced by the burning of propellants used in modern firearm cartridges. These gasses and combustion products leave the muzzle of a firearm at super-sonic speeds creating a shock wave and Mach disk that is the is the source of the loud report associated with firearm discharge. Unburned and partially burned propellants also exit the muzzle creating a flash of bright light that can be undesirable.

The performance of this type of suppressor/silencer is only moderately successful, there still exists a high decibel sound and sometimes a flash still associated with this type of device. The use of different types of baffles are only partially successful in the reduction in sound and flash.

Alternatively, asymmetrical baffles can be more effective in the reduction of noise, but have the undesirable effect of causing deviation in the path of the projectile leading to poor ballistic performance of the fired bullet.

Therefore, a new design of firearm suppression is desired that further reduces the sound and flash than the previous devices.

SUMMARY

A suppressor/silencer comprised of a first (upstream) section that attaches to a firearm comprising: a casing, comprising; a hollow connection member having a first end and a second end, wherein the first end has a first thread opening and the second end has a second threaded opening, an elongated hollow member having a first end a second end, wherein the first end is threaded to mate with the second end of the hollow connection member and the second end has a grooved portion, and an end cap sized to fit within the grooved portion of the elongated hollow member, a first hollow diffuser tube having a first end and a second end, wherein the second end is threaded; an upstream disk, wherein the disk has a centric opening that is threaded to mate with the second end of the first diffuser tube and has a thickness that is less than the length of the second end of the first diffuser tube that is threaded and has an external diameter to securely fit within the elongated hollow member; a second hollow diffuser tube having a first end and a second end, wherein a predetermined distance from the first end towards the second end the internal surface is threaded to mate with the second end of the first hollow diffuser tube; an end cap having a centric opening that is threaded to mate with the second end of the second hollow diffuser tube and has an external diameter to securely fit within the second end of the elongated hollow member; and a wire mesh or other material that is wrapped around the diffuser tubes.

DETAILED DESCRIPTION

The present invention provide a suppressor that further improves the ability to reduce the sound and muzzle blast of firearms. The advantage of the present invention it is much quieter. it does not require hearing protection when using a firearm. According to Occupational Safety and Health Administration (OSHA) guidelines sound above 140 decibel (db) is injurious to hearing. this device greatly reduces the db levels allowing a shooter to no longer need hearing protection to avoid hearing damage the invention can be used with various firearms from hand guns to rifles. This provides an improved silencer/suppressor for numerous firearms.

The advantage of the invention is its quietness and superior flash suppression compared to other designs. Other suppressor designs are based on the use of various types of baffles, this has not changed in over 100 years. this new suppressor design does away with the baffles and achieves a superior effect with the use of the central passage, with holes or ports and the screen or ribbon to slow and cool gasses and other products of a modern firearm cartridge, therefore sound and flash reduction are greatly improved over previous designs.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. It is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Unless defined otherwise, all technical and scientific terms used herein have the same meaning as commonly understood by one of ordinary skill in the art to which this invention belongs. Although any methods and materials similar or equivalent to those described herein may also be used in the practice or testing of the present invention, the preferred methods and materials are now described.

It must be noted that as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

Figure 1:
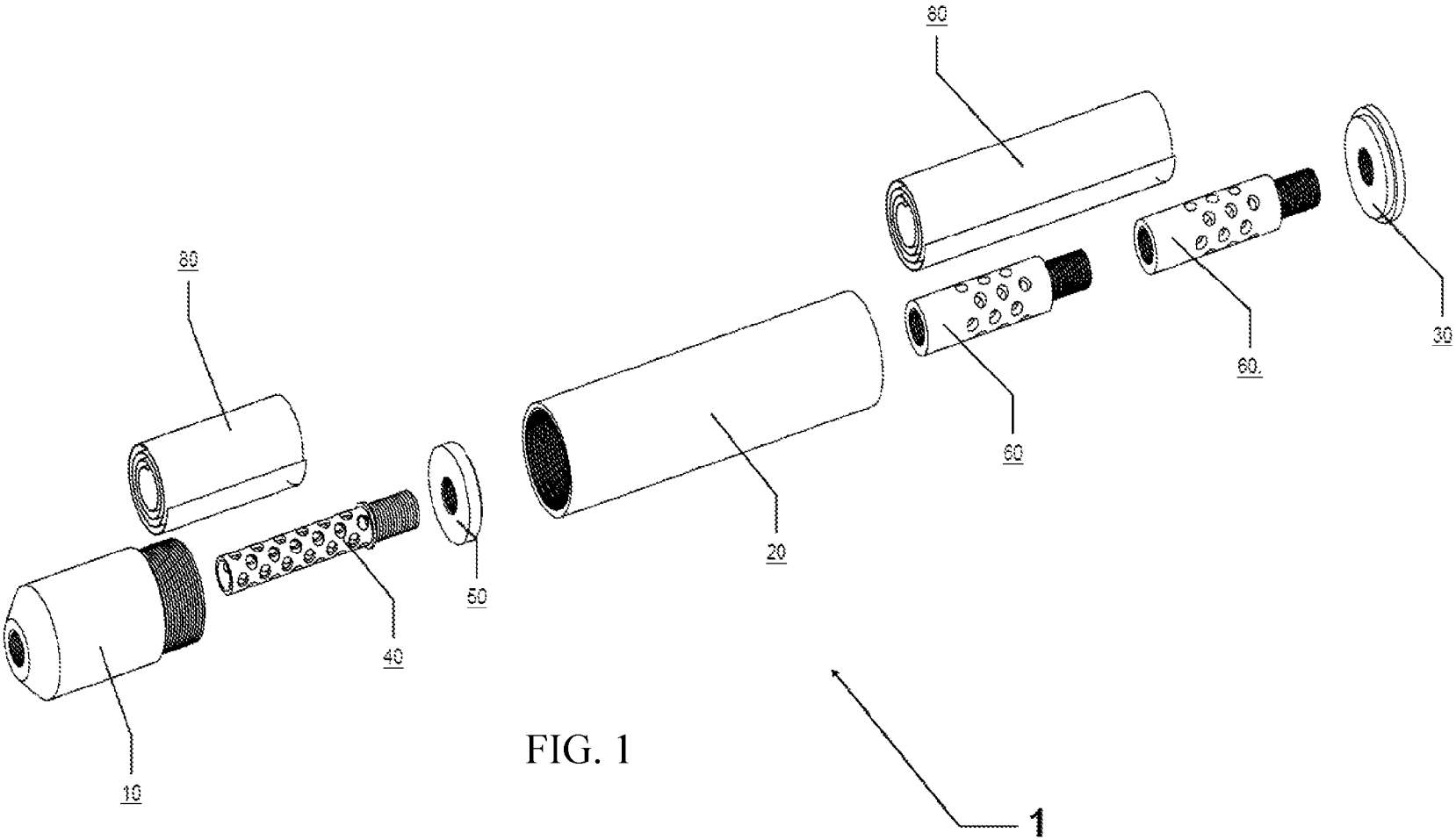
FIG. 1 is an exploded view of the suppressor, in accordance with an embodiment of the present invention.

FIG. 1 depicts an exploded view of the suppressor 1, in accordance with one embodiment of the present invention. The suppressor 1 is comprised of an initial blast chamber 10, a first diffuser tube 40, a plurality of mesh covers 80, an upstream disk 50, a first exterior casing 20, a plurality of second diffuser tubes 60, and an end cap 30.

Figure 2:
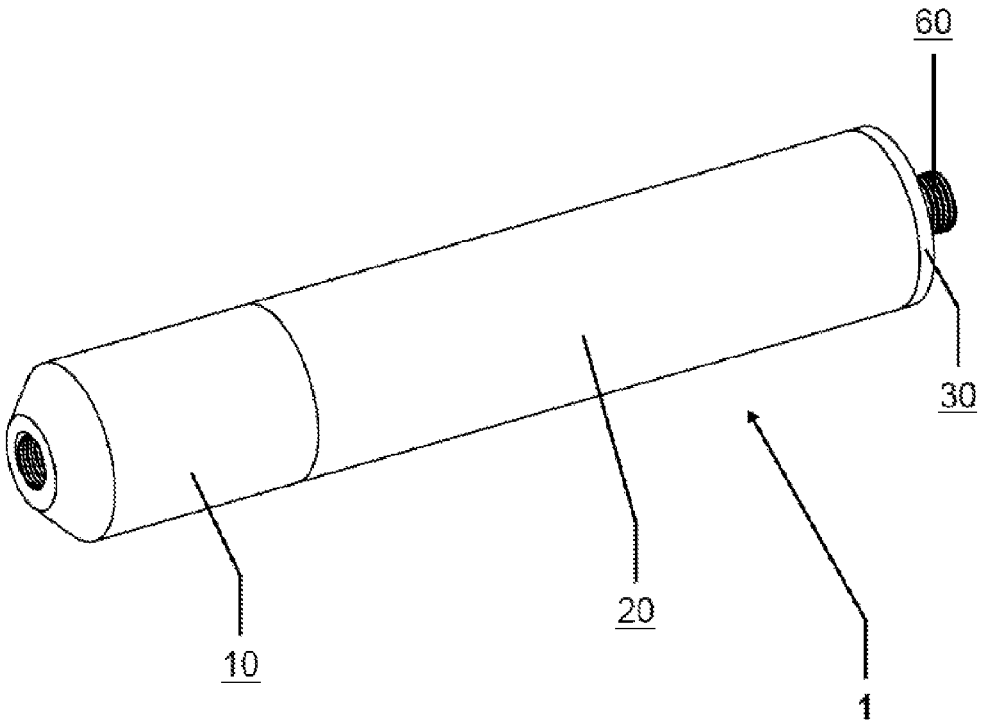
FIG. 2 is an isometric view of the suppressor, in accordance with an embodiment of the present invention.

FIG. 2 depicts an isometric view of the suppressor 1, in accordance with an embodiment of the present invention. The suppressor 1 is fully assembled showing the initial blast chamber 10, the first exterior casing 20, the end cap 30 and a portion of one of the second diffuser tube 60 extending beyond the end cap 30.

Figure 3:
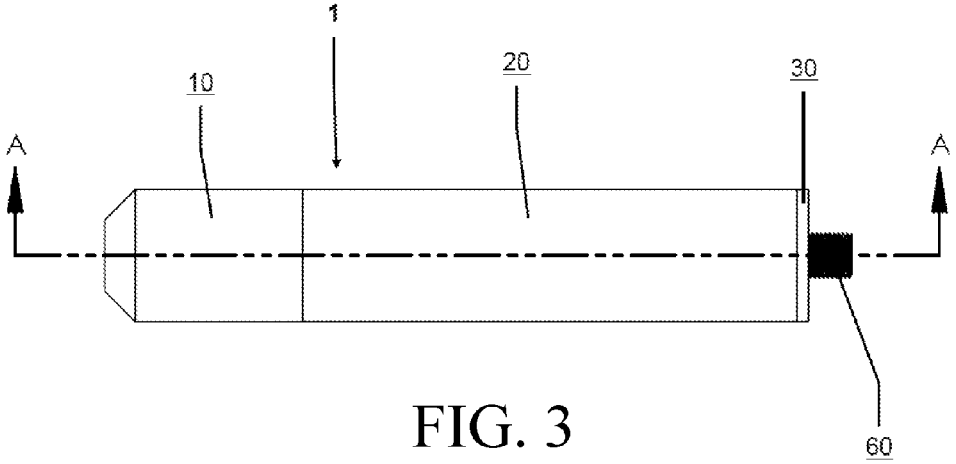
FIG. 3 is a side view of the suppressor, in accordance with an embodiment of the present invention.

FIG. 3 depicts a side view of the suppressor 1, in accordance with an embodiment of the present invention. The suppressor 1 is fully assembled showing the initial blast chamber 10, the first exterior casing 20, the end cap 30 and a portion of the second diffuser tube 60 extending beyond the end cap 30.

Figure 4:
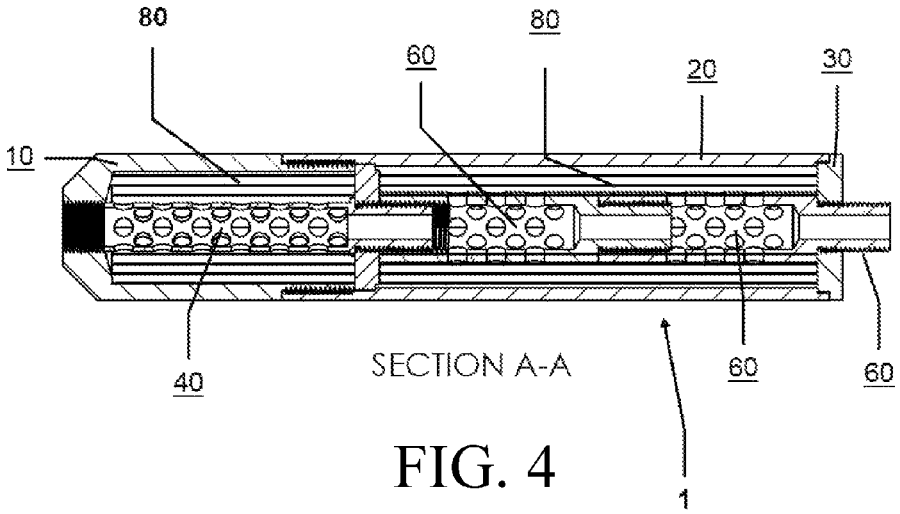
FIG. 4 is a cross section of the suppressor along Line A-A in FIG. 3, in accordance with an embodiment of the present invention.

FIG. 4 is a cross section of the suppressor 1 along Line A-A in FIG. 3, in accordance with an embodiment of the present invention. The internal elements of the suppressor 1 are shown assembled. The mesh cover 80 is shown filling the space between the diffusers 40 and 60 and the casing members 10 and 20. The central passage through the diffusers 40 and 60 is substantially straight and has nothing within the central passage that would come in contact with the bullet or projectile. The mesh cover 80 is shown in two different sizes, to fit around diffuser 40 and also fit around both of the second diffusers 60.

The mesh cover 80 is wound or coiled around the outside of the diffuser tubes 40 and 60. Various sizes of mesh are usable in the invention. Ranging from one (1) wires per inch to eight hundred (800) wires per inch, depending on the cartridge being suppressed. Channeling the gasses and other high energy products of the cartridge being fired through the mesh 80 allows them to slow and cool. This greatly reduces the sound and flash of a firearm. Any high strength material capable of withstanding the temperatures and pressures involved with the discharge of a firearm may be used for this screen, mesh, foam or ribbon without departing from the intended scope of the instant invention. In the preferred embodiment of the present invention, the screen, mesh, foam, titanium open cell foams, or ribbon, or the like can be welded or soldered to maintain the shape and dimension of the coil to facilitate its removal for cleaning or replacement.

The thickness and tightness of the weave of the mesh 80 are determined by the particular cartridge used by the firearm, larger or smaller depending on the amount and pressure of these gasses and other high energy products produced by the ignition of a particular cartridge. The slowing and cooling results in significant reduction in sound and flash.

Figure 5:
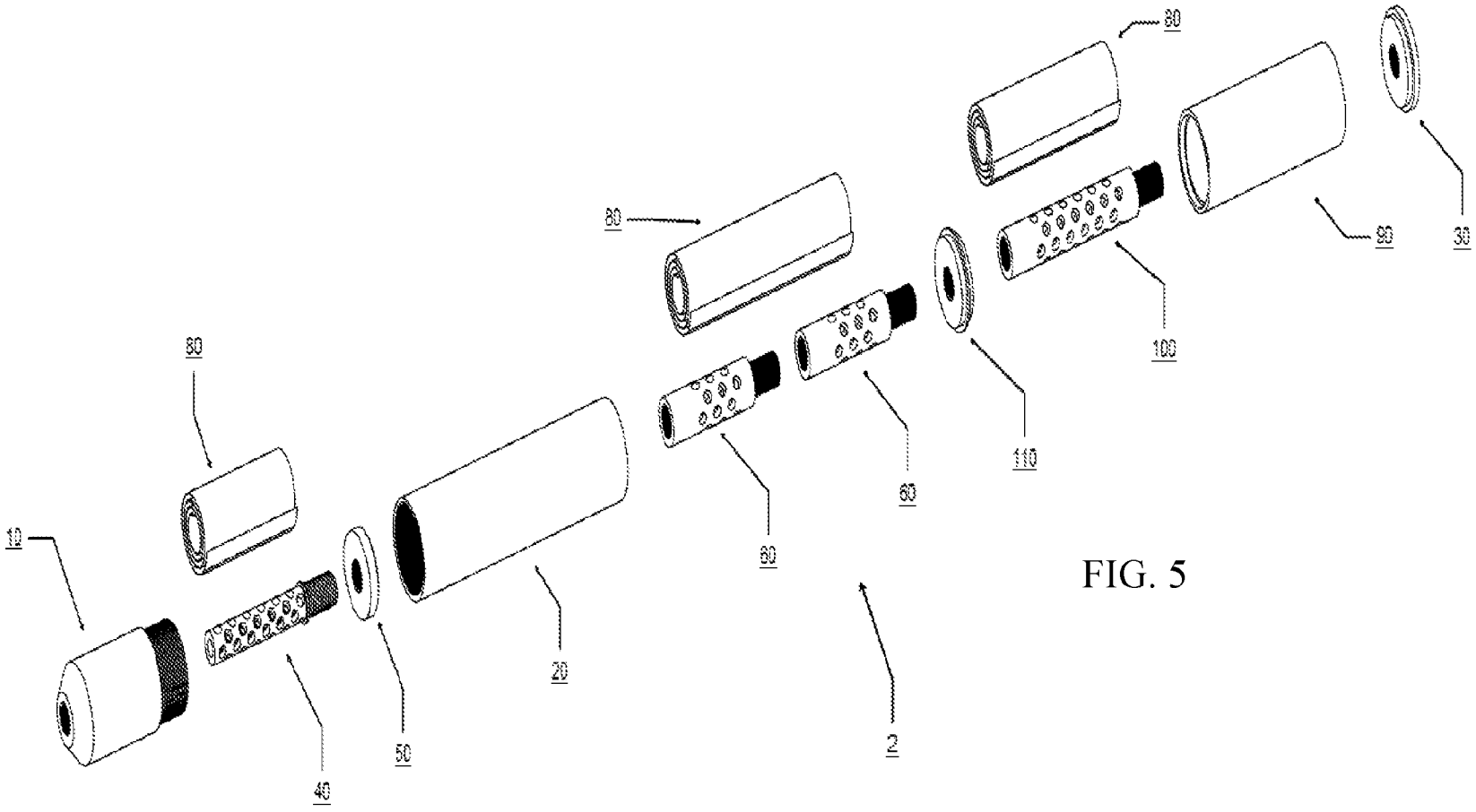
FIG. 5 is an exploded view of the suppressor, in accordance with another embodiment of the present invention.

FIG. 5 is an exploded view of the suppressor 2, in accordance with another embodiment of the present invention. In the depicted embodiment, the suppressor 2 is comprised of the initial blast chamber 10, the first diffuser tube 40, the plurality of mesh covers 80, the upstream disk 50, the first exterior casing 20, the second diffuser tubes 60, the third diffuser tube 100 the second exterior casing 90, the downstream disk 110, and the end cap 30. The depicted embodiment, with the third diffuser tube 100 is substantially quieter.

Figure 6:
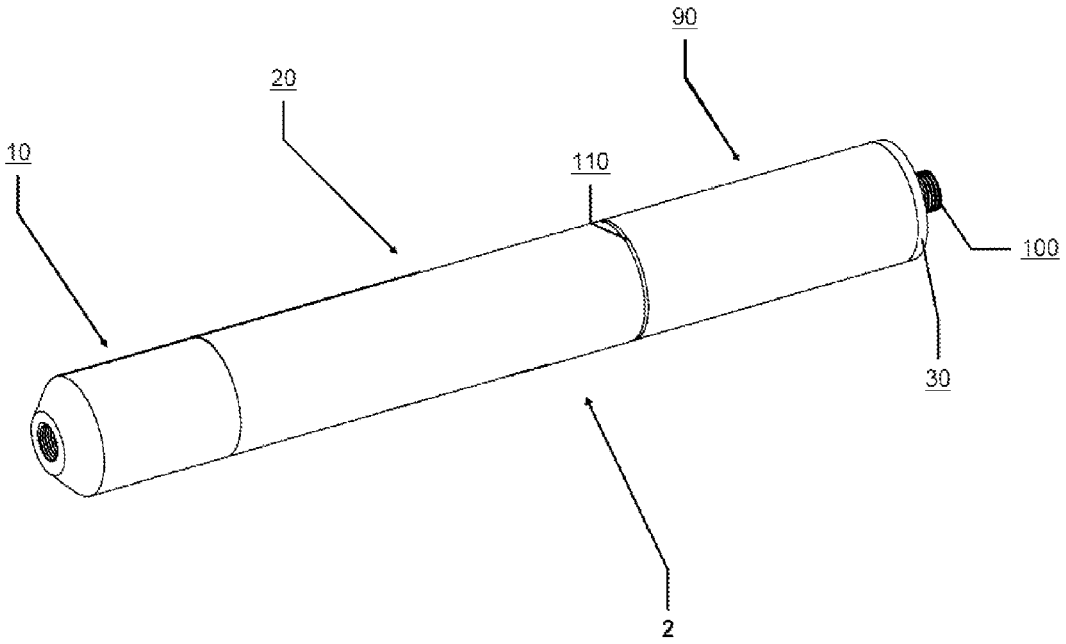
FIG. 6 is an isometric view of the suppressor, in accordance with another embodiment of the present invention.

FIG. 6 is an isometric view of the suppressor 2, in accordance with an embodiment of the present invention. The suppressor 2 is fully assembled showing the initial blast chamber 10, the exterior casing 20, the second exterior casing 90, the end cap 30, the downstream disk 110, and the end of the third diffuser tube 100 exposed, while the remainder of the elements are contained inside.

Figure 8:
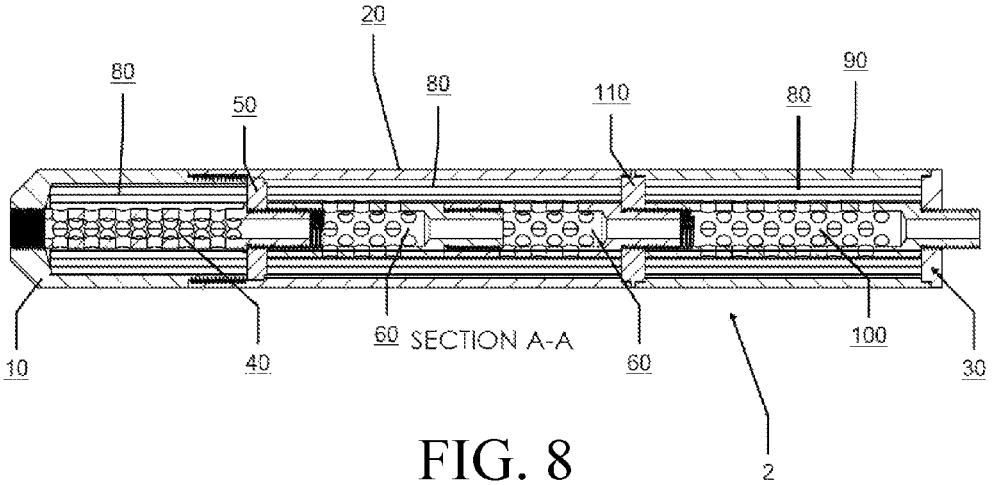
FIG. 8 is a side view of the suppressor, in accordance with another embodiment of the present invention with a section line.

FIG. 8 is a side view of the suppressor 2, in accordance with an embodiment of the present invention. The suppressor 2 is fully assembled showing the initial blast chamber 10, the exterior casing 20, the second exterior casing 90, the downstream disk 110 and the end cap 30 and the end of the third diffuser tube 100 exposed, while the remainder of the elements are contained inside.

Figure 7:
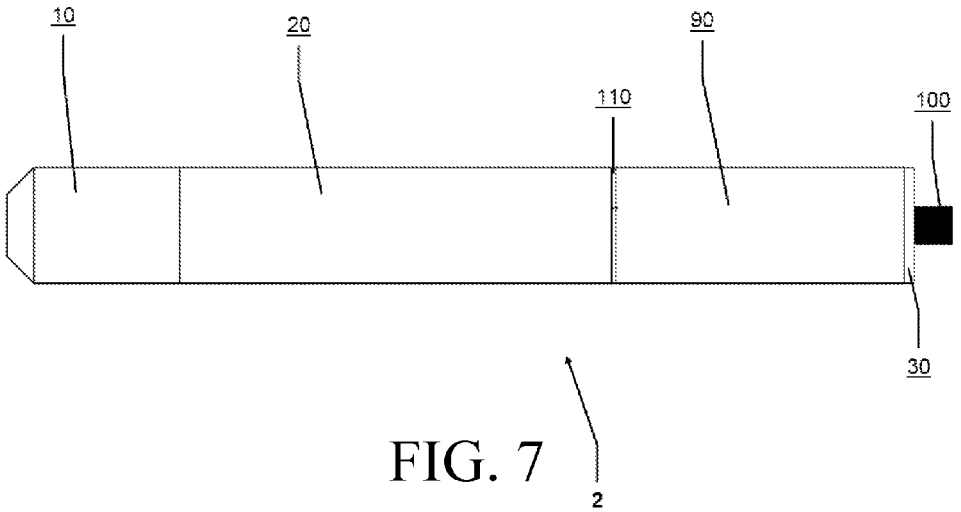
FIG. 7 is a cross section of the suppressor along Line A-A in FIG. 7, in accordance with another embodiment of the present invention.

FIG. 7 is a cross section of the suppressor 2 along line A in FIG. 7, in accordance with an embodiment of the present invention. The internal elements of the suppressor 2 are shown fitted together. Suppressor 2 is similar to suppressor 1 except for the addition of the downstream disk 110, the third diffuser tube 100 and the second exterior casing 90 which are necessary to create the longer suppressor.

Figure 9:
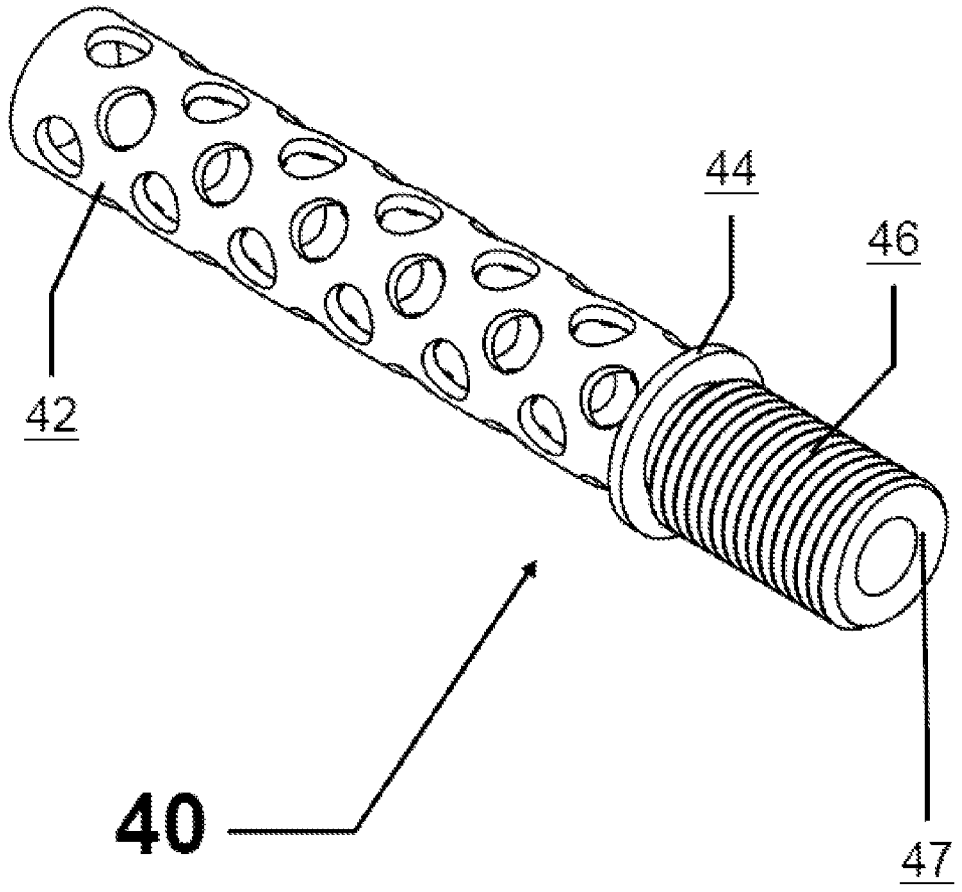
FIG. 9 is an isometric view of a first diffuser tube, in accordance with an embodiment of the present invention.
Figure 10:
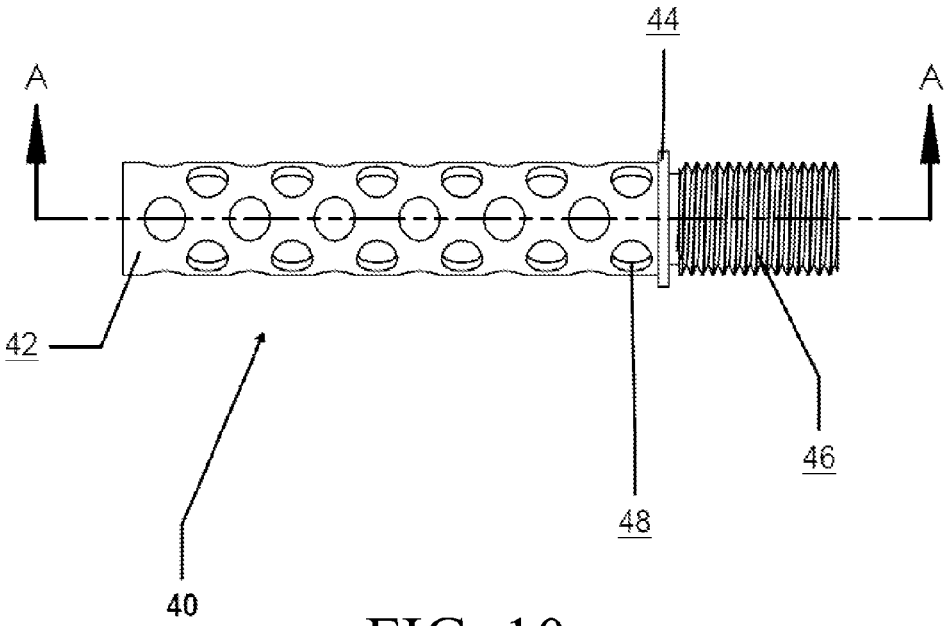
FIG. 10 is a side view of the first diffuser tube, in accordance with an embodiment of the present invention.
Figure 11:
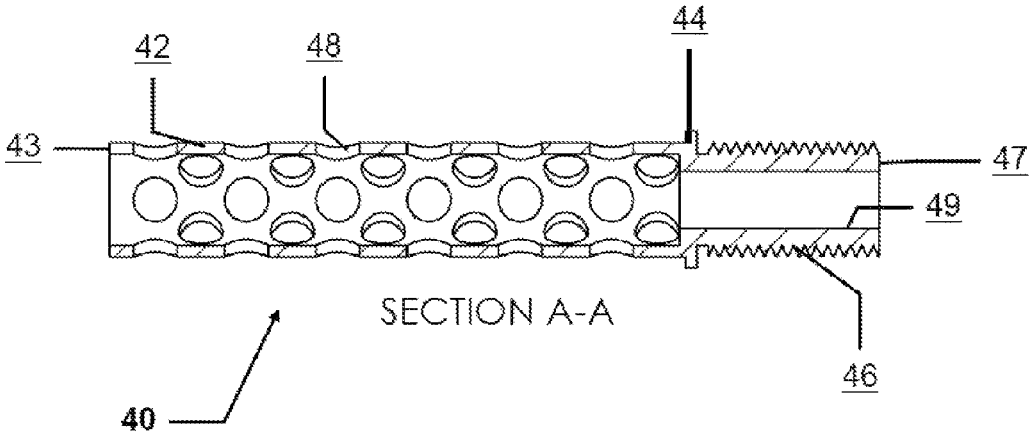
FIG. 11 is a section view of the first diffuser tube along Line A-A, in accordance with an embodiment of the present invention.

FIGS. 9-11 show various views of the first diffuser tube 40, in accordance with an embodiment of the present invention. The first diffuser tube 40 is a hollow tube with a first portion 42 and a second portion 46. These portions are separated by a protrusion 44 which extends a predetermined distance from a center axis of the first diffuser tube 40. The first portion has a plurality of openings 48. The openings 48 may be substantially the same diameter as shown in the depicted embodiment. In additional embodiments, the openings 48 may be of various diameters. The openings 48 are positioned to allow the energetic products of cartridge ignition to flow into and out of the interior chamber of the first diffuser tube 40. The outflow of these gases and other high energy products of cartridge ignition is facilitated by the constriction of the central passage of the first diffuser tube 40. The gasses and other high energy products produced by the ignition of the cartridge are slowed and cooled by their passage through the openings 48. The openings 48 are positioned in a predetermined way to maximize the number of openings while also providing enough structural rigidity. In the depicted embodiment, the openings 48 are in an alternating pattern as depicted in the figures. In additional embodiments, the openings 48 may be positioned in substantially straight rows. The openings 48 may be placed over a predetermined portion of the first portion 42 distal to the first end 43.

In the depicted embodiment, the second portion 46 is threaded a predetermined distance from the protrusion 44 and terminates at the end 47. In additional embodiments, the threads may vary depending on the size of the upstream disk 40. In the depicted embodiment, the first portion 42 is of a predetermined thickness which is less than that of the second portion 46. In additional embodiments, the thickness of the first portion 42 and the second portion 46 may be substantially similar or varied based on the type of firearm the suppressor is designed for. This is affected by the caliber of the bullet and the amount of heat and gas which is created by the various types of bullet calibers, powder types and charge weights. The second portion 46 is sized to receive and mate with the upstream disk 50, wherein the threads permit upstream disk 50 to substantially mate with the protrusion 44. The first diffuser tube 40 has a wall thickness and robust enough construction to contain the initial ejection of gasses and other products produced by the firing of a modern firearms cartridge.

Figure 12:
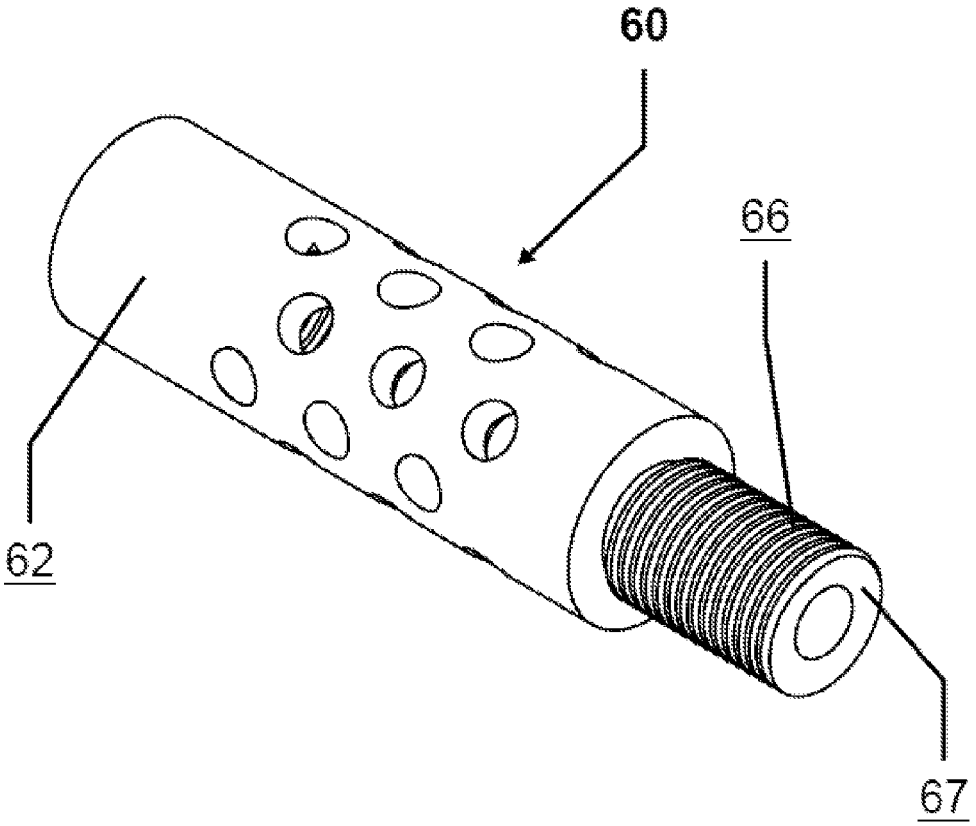
FIG. 12 is a side view of the second diffuser tube, in accordance with an embodiment of the present invention.
Figure 13:
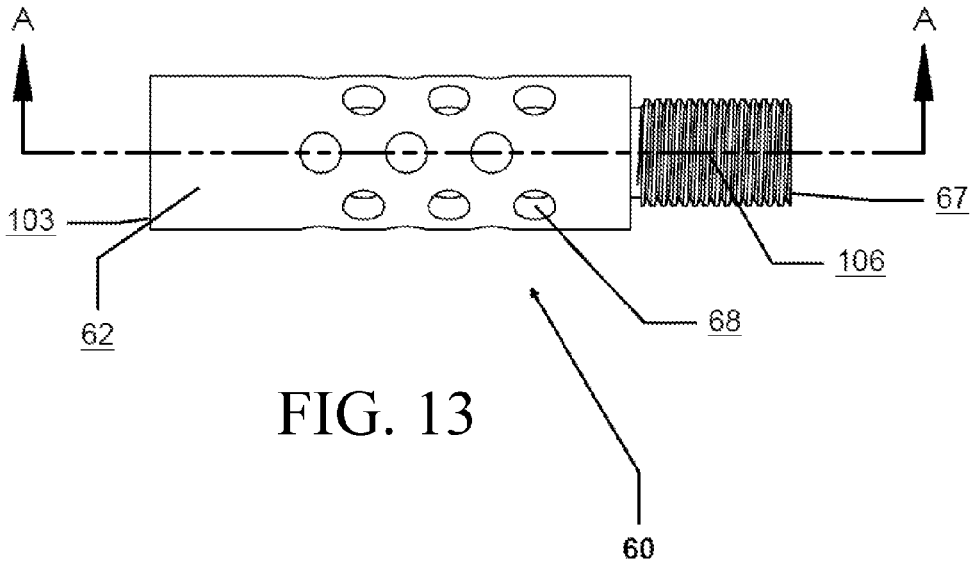
FIG. 13 is an isometric view of a second diffuser tube, in accordance with an embodiment of the present invention.
Figure 14:
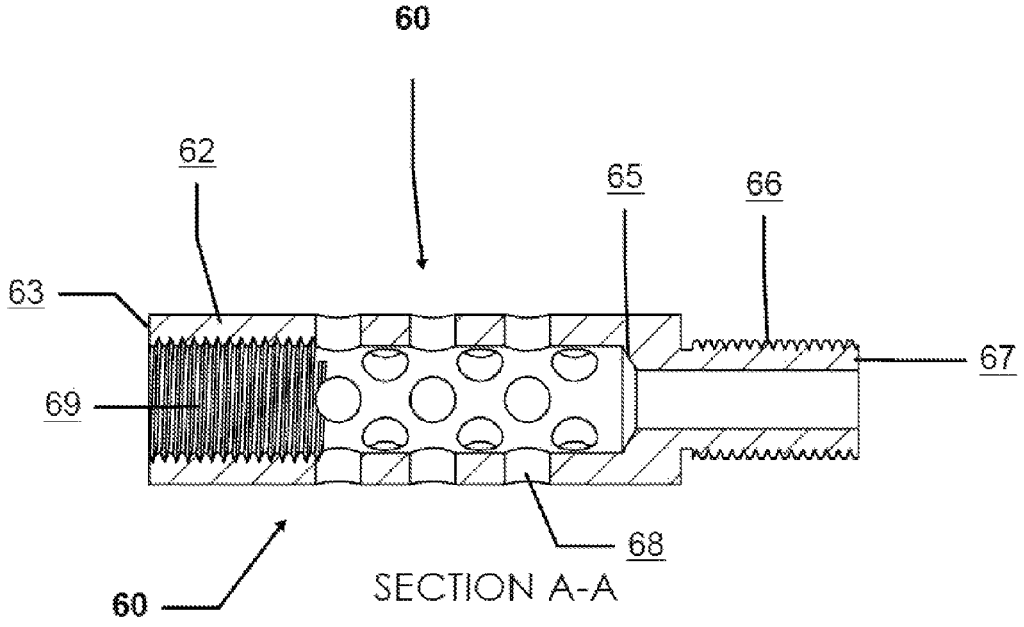
FIG. 14 is a section view of the second diffuser tube along Line A-A, in accordance with an embodiment of the present invention.

FIGS. 12-14 show various views of the second diffuser tube 60, in accordance with an embodiment of the present invention. The second diffuser tube 60 is a hollow tube with a first portion 62 and a second portion 66. These portions are of varying diameters. The first portion has a plurality of openings 68. The openings 68 may be substantially the same diameter as shown in the depicted embodiment. In additional embodiments, the openings 68 may be varying diameters. The openings 68 are positioned to allow the energetic products of cartridge ignition to flow into and out of the interior chamber of the second diffuser tube 60. The outflow of these gases and other high energy products of cartridge ignition is facilitated by the constriction of the central passage of the second diffuser tube 60. The gasses and other high energy products produced by the ignition of the cartridge are slowed and cooled by their passage through the openings 68. The openings 68 are positioned in a predetermined way to maximize the number of openings while also providing enough structural rigidity. In the depicted embodiment, the openings 68 are in an alternating pattern as depicted in the figures and being a predetermined distance from the first end 63. In additional embodiments, the openings 68 may be positioned in substantially straight rows. The opening 68 may be placed over a predetermined portion of the first portion 62 distal to the first end 63.

The second portion 66 is threaded a predetermined distance from the end 67. In the depicted embodiment, the threaded portion terminates substantially at the end of the second portion 106. In the depicted embodiment, the first portion 62 is of a predetermined thickness which is less than that of the second portion 66. In additional embodiments, the thickness of the first portion 62 and the second portion 66 may be substantially similar or varied based on the type of firearm the suppressor is designed for. This is affected by the caliber of the bullet, type of powder and charge weight and the amount of heat and gas which is created by the various types of bullets.

In FIG. 14, it is shown that the interior cavity of the first portion 62 beginning at the first end 63 the interior surface has a threaded portion 69. The threaded portion 69 extends a predetermined distance towards the second portion 66. In the depicted embodiment, the threaded portion 69 terminates at approximately the beginning of where the openings 68 start. In additional embodiments, the openings and the threaded portion 69 may overlap. Additionally, in the depicted embodiment, the first portion 62 is chamfered 65 where it is transferred to the second portion 66. The threads 69 are sized to mate with the threads on the second portion 46 of the first diffuser tube 40. The threads 66 are sized to mate with the threads 109 on the third diffuser tube 100.

Figure 15:
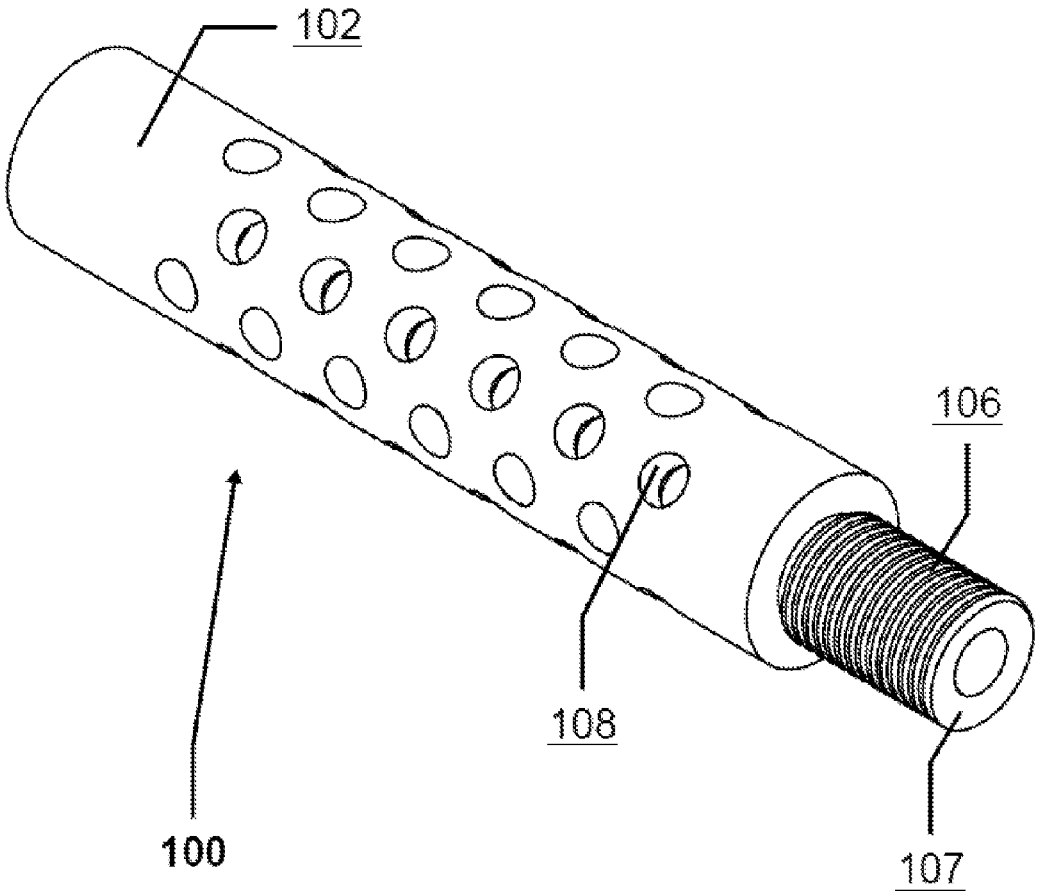
FIG. 15 is an isometric view of a third diffuser tube, in accordance with an embodiment of the present invention.
Figure 16:
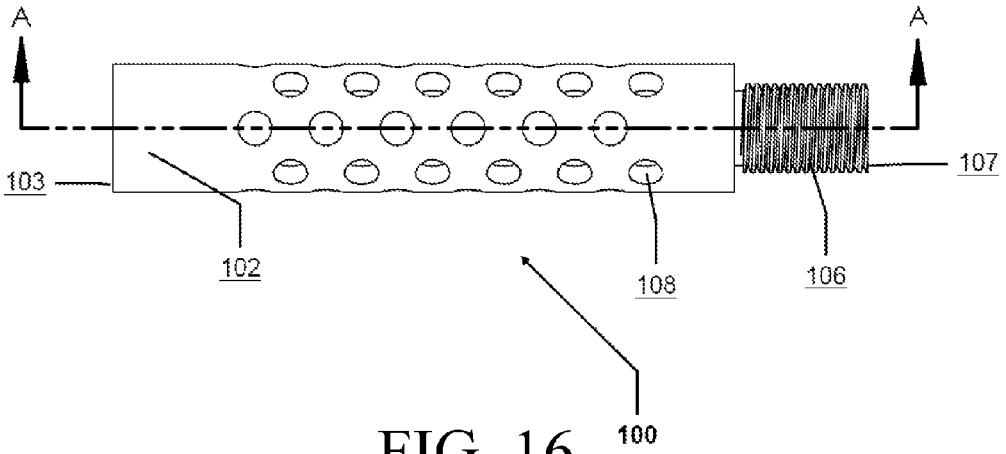
FIG. 16 is a side view of the third diffuser tube, in accordance with an embodiment of the present invention.
Figure 17:
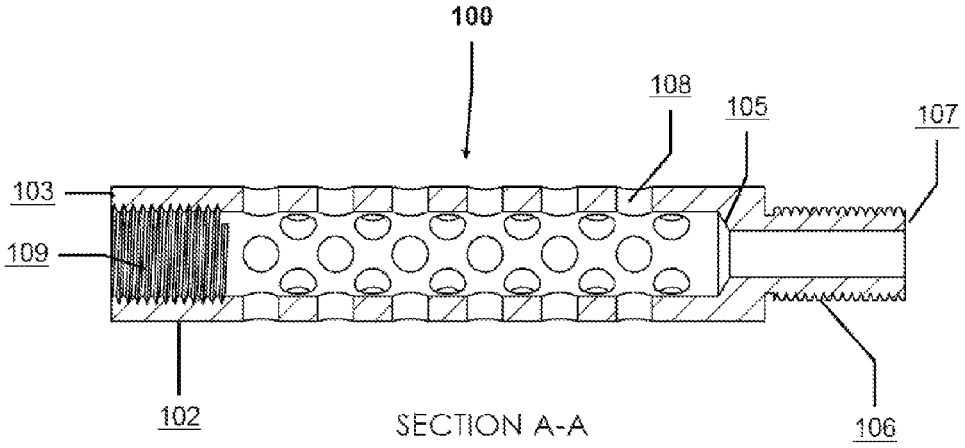
FIG. 17 is a section view of the third diffuser tube along Line A-A, in accordance with an embodiment of the present invention.

FIGS. 15-17 show various views of the third diffuser tube 100, in accordance with an embodiment of the present invention. The second diffuser tube 60 is a hollow tube with a first portion 102 and a second portion 106. These portions are of varying external and internal diameters. The first portion has a plurality of openings 108. The openings 108 may be substantially the same diameter as shown in the depicted embodiment. In additional embodiments, the openings 108 may be varying diameters. The openings 108 are positioned to allow the energetic products of cartridge ignition to flow into and out of the interior chamber of the third diffuser tube 100. The outflow of these gases and other high energy products of cartridge ignition is facilitated by the constriction of the central passage of the third diffuser tube 100. The gasses and other high energy products produced by the ignition of the cartridge are slowed and cooled by their passage through the openings 108. The openings 108 are positioned in a predetermined way to maximize the number of openings while also providing enough structural rigidity. In the depicted embodiment, the openings 108 are in an alternating pattern as depicted in the figures and being a predetermined distance from the first end 103. In additional embodiments, the openings 108 may be positioned in substantially straight rows. The openings 108 may be placed over a predetermined portion of the first portion 102 distal to the first end 103.

The second portion 106 is threaded a predetermined distance from the second end 107 towards first portion 103. In the depicted embodiment, the threaded portion terminates substantially at the exchange to the first portion. In the depicted embodiment, the first portion 102 is of a predetermined thickness which is less than that of the second portion 106. In additional embodiments, the thickness of the first portion 102 and the second portion 106 may be substantially similar or varied based on the type of firearm the suppressor is designed for. This is affected by the caliber of the bullet, powder type, and charge weight and the amount of heat and gas which is created by the various types of bullets.

In FIG. 17, it is shown that a portion of the interior cavity of the first portion 102 beginning at the first end 103, the interior surface of the diffuser is threaded. The threaded portion extends a predetermined distance towards the second end 107. In the depicted embodiment, the threaded portion 109 terminates at approximately the beginning of the openings 108. In additional embodiments, the openings and the threaded portion 109 may overlap. Additionally, in the depicted embodiment, the first portion 102 is chamfered 105 where it is transferred to the second portion 106. The threads 106 are sized to mate with the threads of the end cap 30. The threads 109 are designed to mate with the threads 66 of the second diffuser chamber 60.

Figure 18:
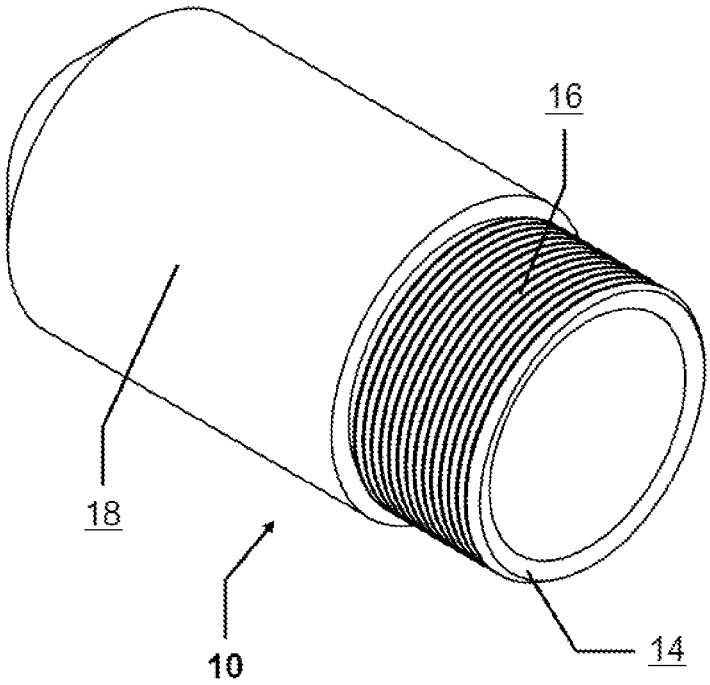
FIG. 18 is an isometric view of an initial blast chamber, in accordance with an embodiment of the present invention.
Figure 19:
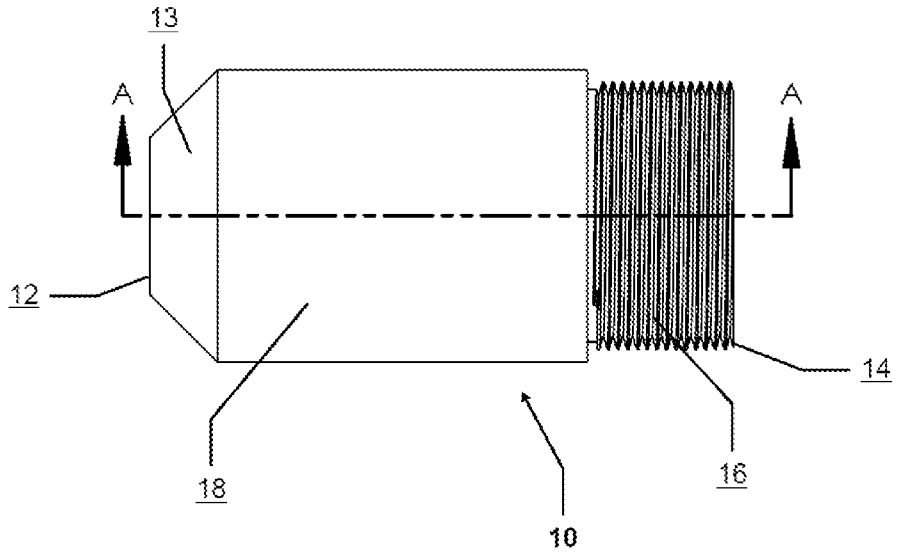
FIG. 19 is a side view of the initial blast chamber, in accordance with an embodiment of the present invention.
Figure 20:
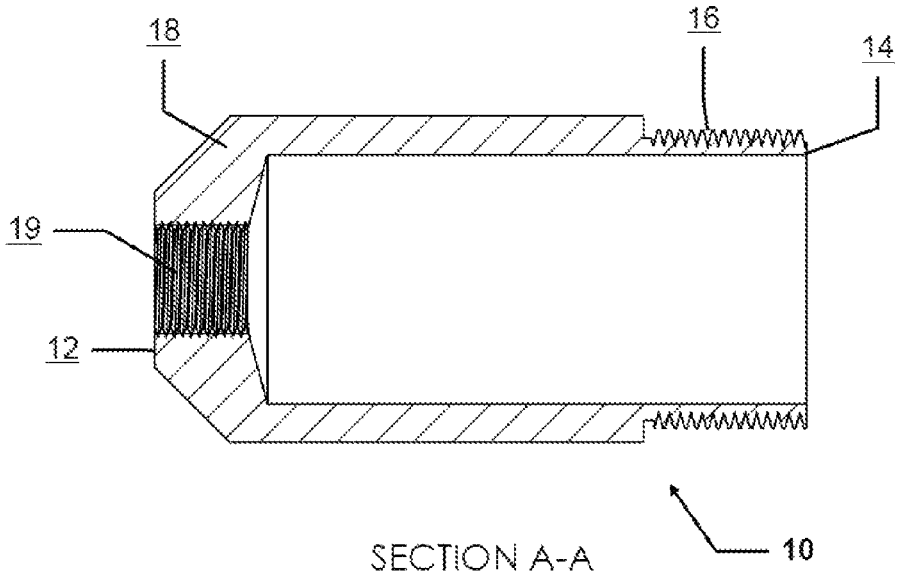
FIG. 20 is a section view of the initial blast chamber along Line A-A, in accordance with an embodiment of the present invention.
Figure 21:
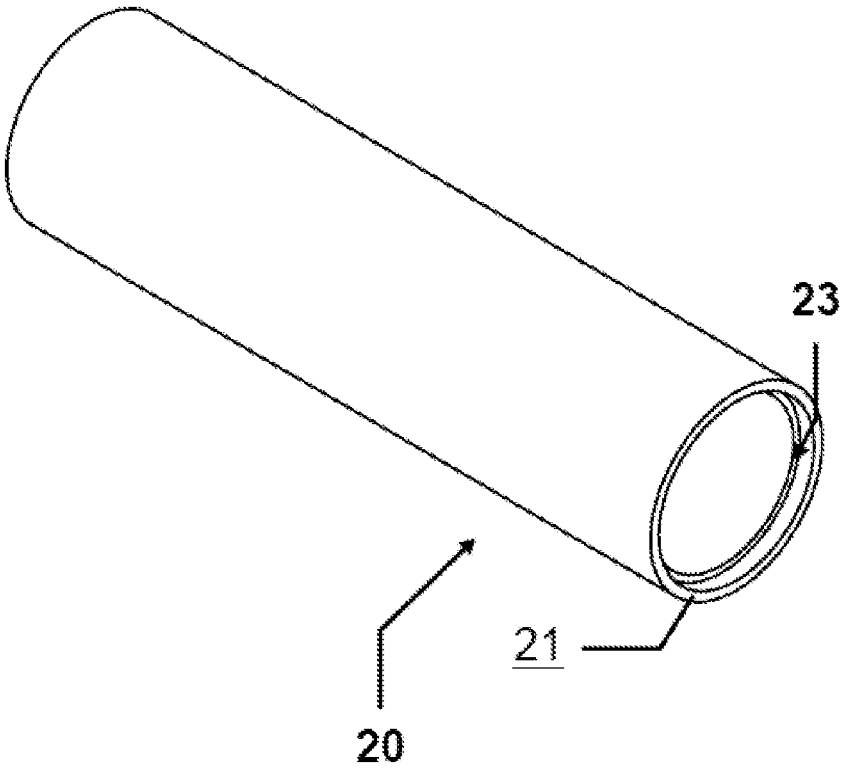
FIG. 21 is an isometric view of the first exterior casing, in accordance with an embodiment of the present invention.
Figure 22:
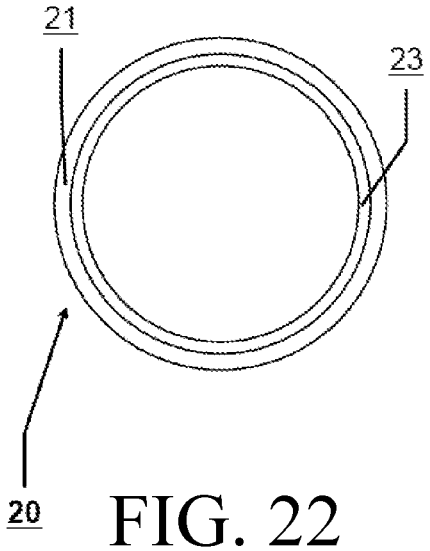
FIG. 22 is a front view of the first exterior casing, in accordance with an embodiment of the present invention.
Figure 23:
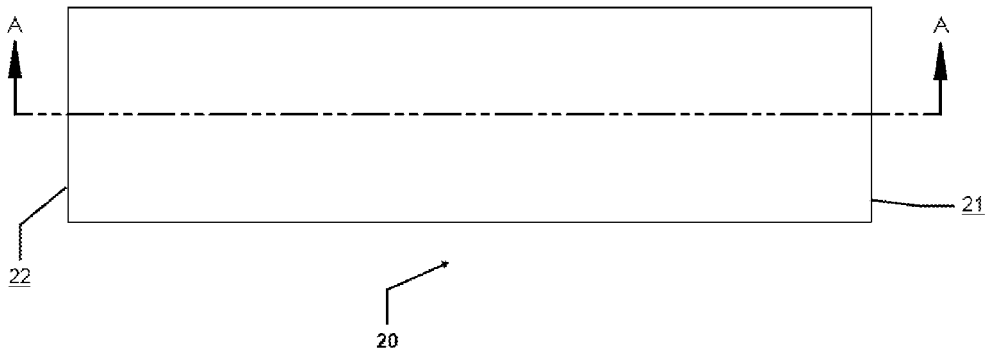
FIG. 23 is a side view of a first exterior casing, in accordance with an embodiment of the present invention.
Figure 24:
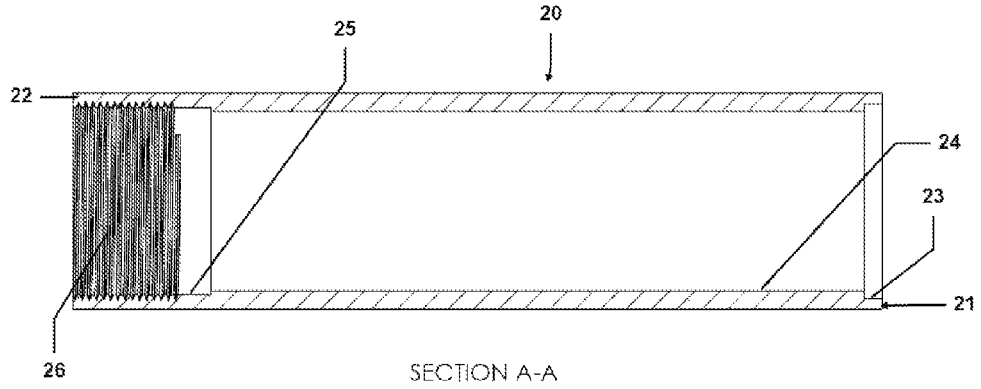
FIG. 24 is a section view of the first exterior casing along Line A-A, in accordance with an embodiment of the present invention.
Figure 25:
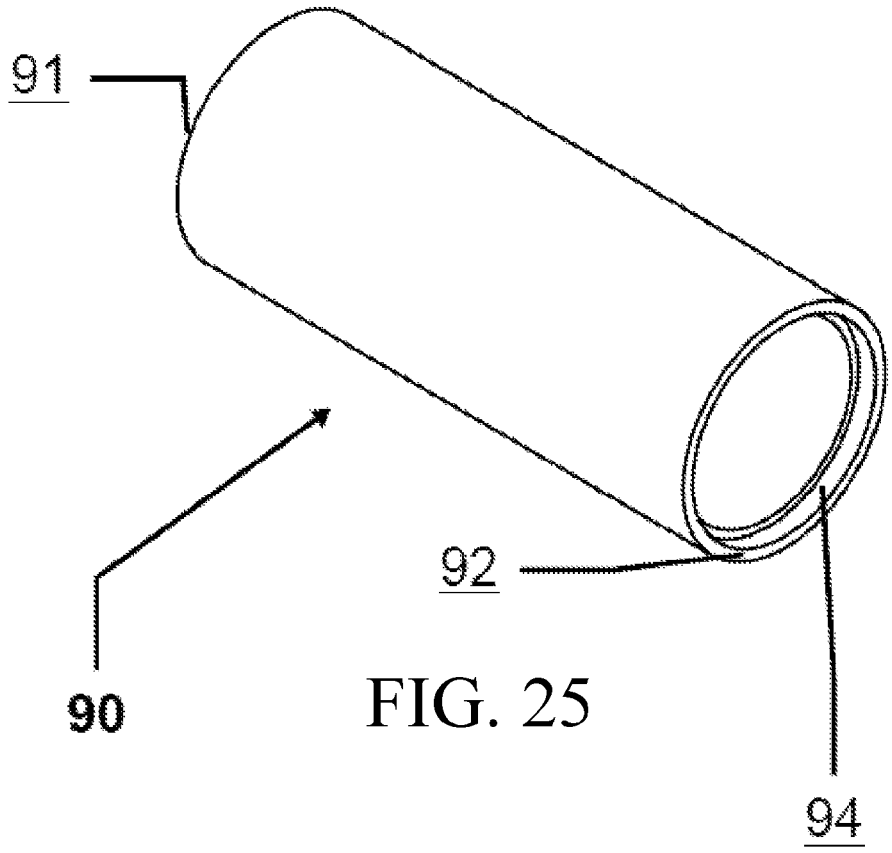
FIG. 25 is an isometric view of the second exterior casing, in accordance with an embodiment of the present invention.
Figure 26:
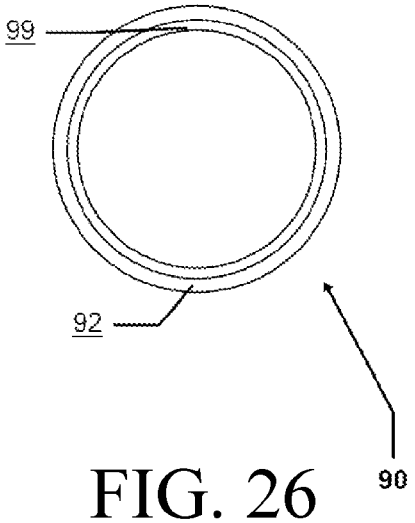
FIG. 26 is a front view of the second exterior casing, in accordance with an embodiment of the present invention.
Figure 27:
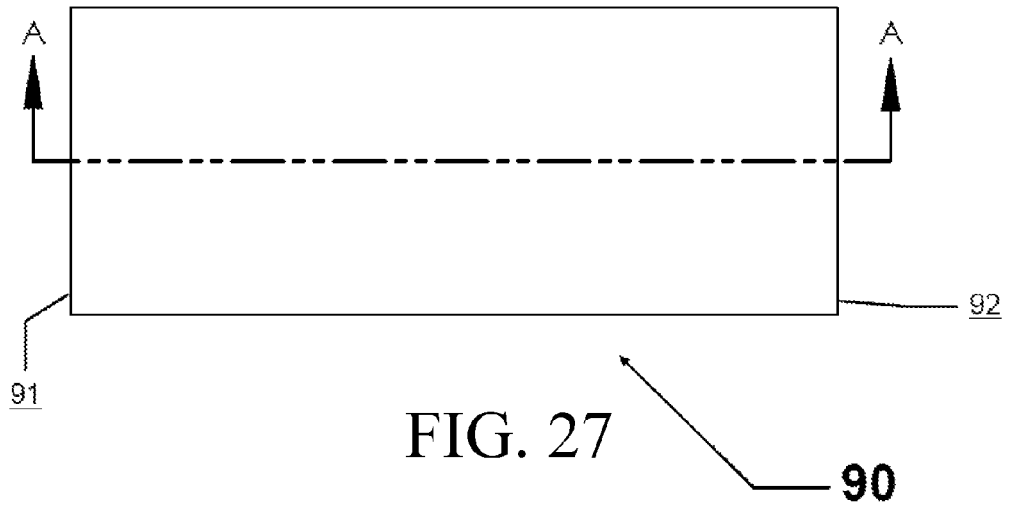
FIG. 27 is a side view of a second exterior casing along Line A-A, in accordance with an embodiment of the present invention.
Figure 28:
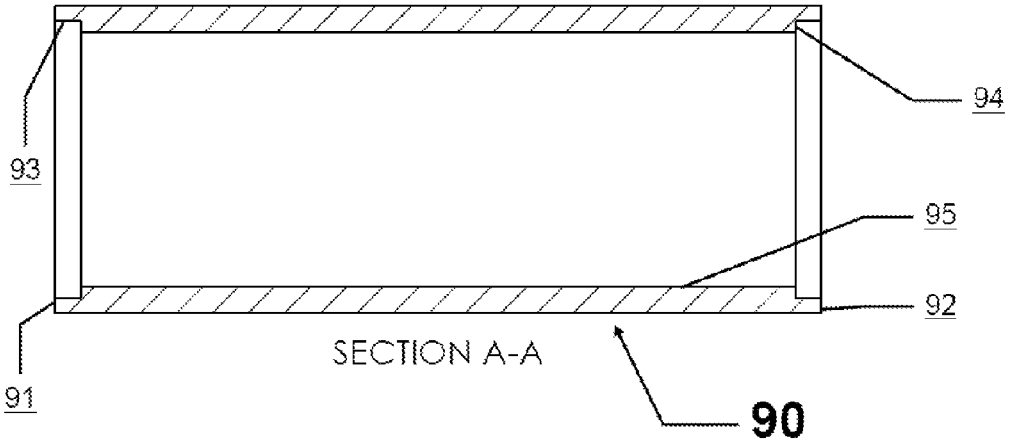
FIG. 28 is a section view of the second exterior casing, in accordance with an embodiment of the present invention.

FIGS. 18-20 are various views of the initial blast chamber 10, in accordance with an embodiment of the present invention. The initial blast chamber 10 attaches to the muzzle end of a firearm barrel. The initial blast chamber 10 is a hollow tube with a first end 12 and a second end 14. The first end 12 mates with the muzzle of the firearm. The second end 14 has a predetermined length of the external surface that is threaded (threaded portion 16) and designed to mate with the first exterior casing 20.

In FIG. 20, a section view of the initial blast chamber is shown, exposing a threaded portion 19 at the first end 12. The thickness of the first end 12 is predetermined to provide adequate structural support and provide adequate material for the threaded portion 19. The threaded portion extends a predetermined length based on the firearm muzzle which the suppressor is designed to attach to. In the depicted embodiment, the interior chamber of the initial blast chamber 10 is substantially equal from the first end 12 to the second end 14. In additional embodiments, the interior diameter of the initial blast chamber 10 may vary between the first end 12 and the second end 14. In the depicted embodiment, the first end 12 has a chamfer 13 leading into the main body. The initial blast chamber 10 is sized to fit the first diffuser tube 40 as well as a predetermined length of the mesh cover 80. In additional embodiments, the chamfer 13 may be of varying degrees or may not be present. The initial blast chamber 10 has a wall thickness and robust enough construction to contain the initial ejection of gasses and other products produced by the firing of a modern firearms cartridge.

FIGS. 21-24 show various views of the first exterior casing 20, in accordance with an embodiment of the present invention. The first exterior casing 20 is a hollow tube with a first end 21 and a second end 22. The first exterior casing 20 is used to house the elements that assist in suppressing the noise and muzzle blast of shots fired from the firearm. The first end 21 of the first exterior casing 20 as a cutout 23. The cutout 23 is of a predetermined depth and width to create a groove substantially sized to fit a portion of the end cap 30 or the downstream disk 110. In the depicted embodiment, the interior surface 24 of the first exterior casing 20 is substantially the same diameter from the first end 21 to the second end 22. In additional embodiments, the interior surface 24 may vary, thereby affecting the diameter from the first end 21 to the second end 22. At the second end 22 a cutout 25 is present. The cutout 25 extends a predetermined distance from the second end and is a predetermined depth. Within the cutout 25, a portion is threaded (threaded portion 26) to mate with the initial blast chamber threaded portion 16 and the portion of cutout 25 that is not threaded is designed to firmly hold downstream disk 50.

FIGS. 25-28 show various views of the second exterior casing 90, in accordance with an embodiment of the present invention. The second exterior casing 90 is a hollow tube with a first end 91 and a second end 92. The second exterior casing 90 has a first cutout 93 at the first end and a second cutout 94 at the second end 92. The cutouts 93 and 94 are of predetermined depths and widths. In the depicted embodiment, the cutouts 93 and 94 are substantially the same depth and widths. In additional embodiments, they may be different. The first cutout 93 is sized to mate with the downstream disk 110. The second cutout 94 is sized to make with the end cap 30.

Figure 29:
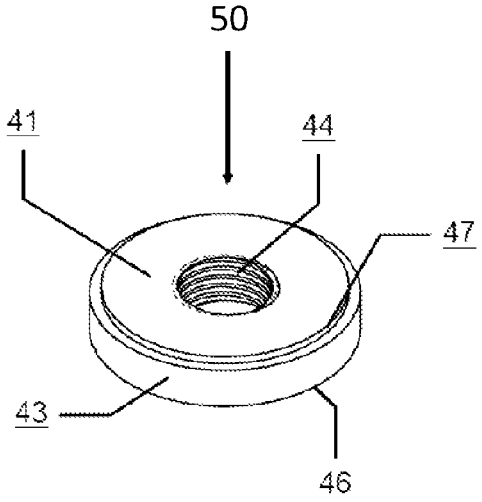
FIG. 29 is an isometric view of an upstream disk, in accordance with an embodiment of the present invention.
Figure 30:
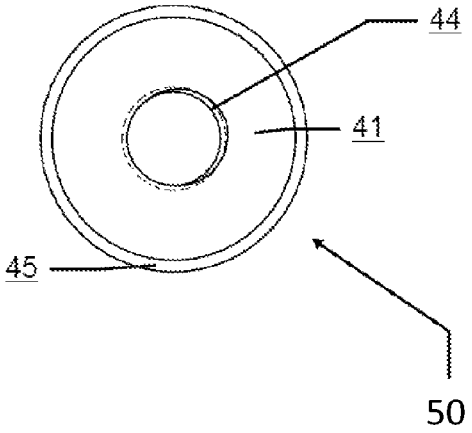
FIG. 30 is a front view of the upstream disk, in accordance with an embodiment of the present invention.
Figure 31:
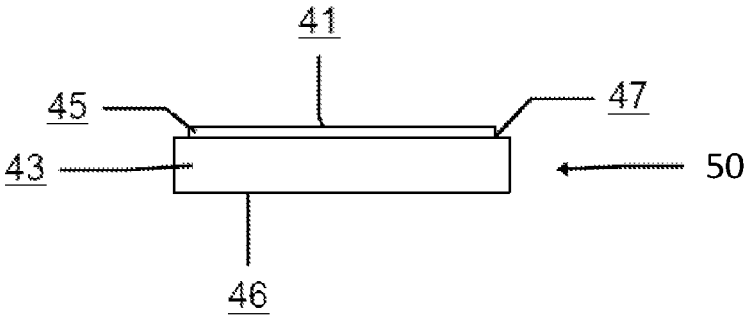
FIG. 31 is a top view of the upstream disk, in accordance with an embodiment of the present invention.

FIGS. 29-31 show various views of the upstream disk 50, in accordance with an embodiment of the present invention. The upstream disk 50 is a multi-layer disk with a central opening 44 with a top surface 41 and a bottom surface 46. The upstream disk 50 is comprised of a first layer 43 and a second layer 47. The first layer 43 and the second layer 47 are sized so that the offset from the first layer 43 to the second layer 47 is substantially the same distance as the thickness of the first exterior casing 20. The first layer 43 has a predetermined thickness. The second layer 47 has a predetermined thickness. The central opening 44 extends through the first layer 43 and the second layer 47. In the depicted embodiment, the central opening 44 is threaded. The central opening 44 is sized to receive the threaded portion 46 of the first diffuser tube 40. In the depicted embodiment, the top surface 41, the offset surface 45 created due to the different diameters of the first layer 43 and the second layer 47, and the bottom surface 46 are substantially parallel in regards to each other. The upstream disk 50 is a unitary design, typically machines from a single piece of material. In some embodiments, the upstream disk 50 is an assembly of multiple pieces.

Figure 32:
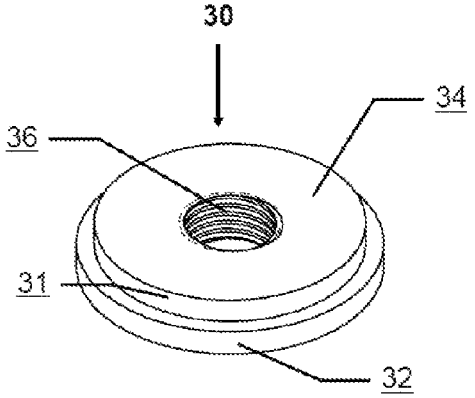
FIG. 32 is an isometric view of an end cap, in accordance with an embodiment of the present invention.
Figure 33:
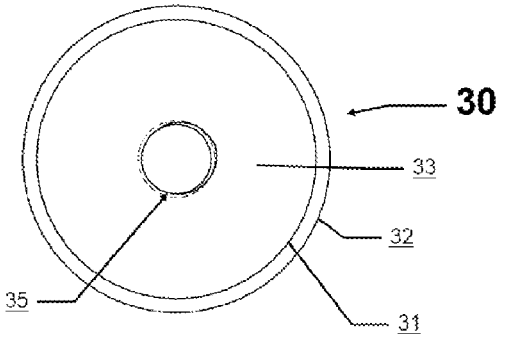
FIG. 33 is a front view of the end cap, in accordance with an embodiment of the present invention.
Figure 34:
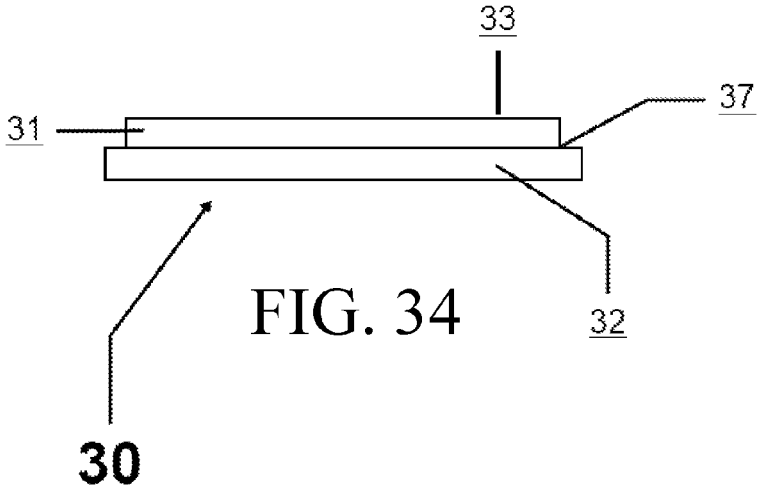
FIG. 34 is a side view of the end cap, in accordance with an embodiment of the present invention.

FIGS. 32-34 show various views of the end cap 30, in accordance with an embodiment of the present invention. The end cap 30 is a multi-layer disk with a central opening 36 with a top surface 33 and a bottom surface 34. The end cap 30 is comprised of a first layer 31 and a second layer 32. The first layer 31 and the second layer 32 are sized so that the offset from the first layer 31 to the second layer 32 is substantially the same distance as the thickness of the first exterior casing 20 and the thickness of the second exterior casing 90. The first layer 31 has a predetermined thickness. The second layer 32 has a predetermined thickness. The central opening 36 extends through the first layer 31 and the second layer 32. In the depicted embodiment, the central opening 36 is threaded. The central opening 36 is sized to receive the threaded portion 66 of the second diffuser tube 60 or the threaded portion 106 of the third diffuser tube 100. In the depicted embodiment, the top surface 33, the offset surface 37 which is created by the different diameters of the first layer 31 and the second layer 32, and the bottom surface 34 are substantially parallel in regards to each other. The end cap 30 is a unitary design, typically machines from a single piece of material. In some embodiments, the end cap 30 is an assembly of multiple pieces.

Figure 35:
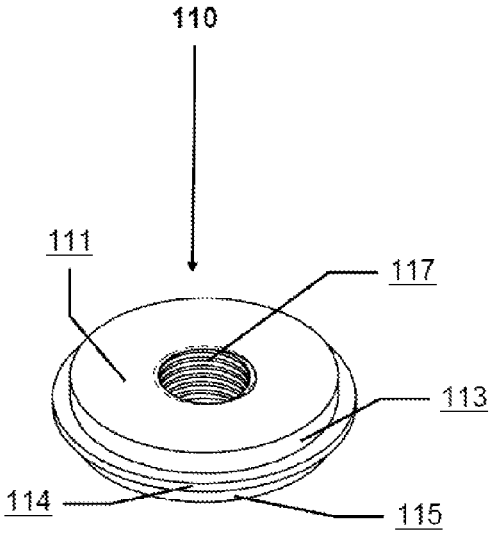
FIG. 35 is an isometric view of the downstream disk, in accordance with an embodiment of the present invention.
Figure 36:
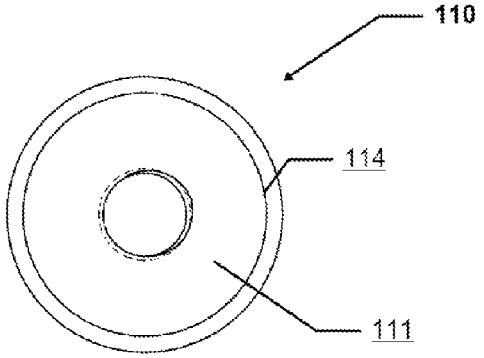
FIG. 36 is a front view of the downstream disk, in accordance with an embodiment of the present invention.
Figure 37:
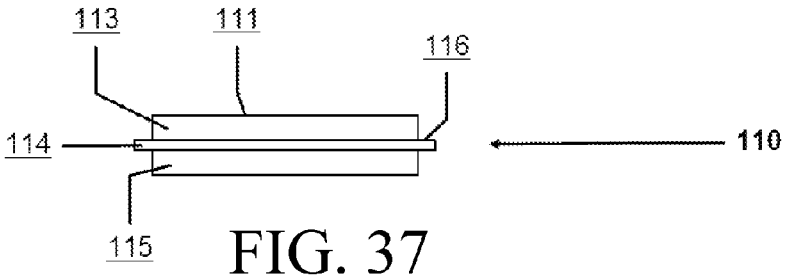
FIG. 37 is a side view of a downstream disk, in accordance with an embodiment of the present invention.

FIGS. 35-37 show various views of the downstream disk 110, in accordance with an embodiment of the present invention. The downstream disk 110 is a multi-layer disk with a central opening 117 with a top surface 111 and a bottom surface 112. The downstream disk 110 is comprised of a first layer 113 a second layer 114, and third layer 115. In the depicted embodiment, the first layer 113 and the third layer 115 are substantially the same size, and the second layer 114 is has a larger diameter and a thinner thickness. This is to allow the downstream disk 110 to mate with the first exterior casing 20 and the second exterior casing 90. In additional embodiments, the layers 113, 114, and 115 may be of varying thicknesses and diameters based on the exterior casing 20 and 90 shape and size. The central opening 117 extends through the layers 113, 114, and 115. In the depicted embodiment, the central opening 117 is threaded. In the depicted embodiment, the top surface 111, the offset surface 116 which is created by the different diameters of layers 113 and 114 and layers 114 and 115, and the bottom surface 34 are substantially parallel in regards to each other. The downstream disk 110 is a unitary design, typically machines from a single piece of material. In some embodiments, the downstream disk 110 is an assembly of multiple pieces.

All the elements of the suppressor 1 or 2 may be formed of aluminum, titanium, stainless steel or Inconel. Any high strength material capable of withstanding the temperatures and pressures involved with the discharge of a firearm may be used without departing from the intended scope of the instant invention.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

The invention claimed is:

1. A suppressor for firearms, comprising:

a casing, comprising;

a hollow connection member having a first end and a second end, wherein the first end has a first thread opening and the second end has a second threaded opening, an elongated hollow member having a first end a second end, wherein the first end is thread to mate with the second end of the hollow connection member and the second end has a grooved portion, and an end cap having a centric opening that is threaded to mate with the second end of the second hollow diffuser tube and has an external diameter to securely fit within the second end of the elongated hollow member, a first hollow diffuser tube having a first end and a second end and a plurality of openings distal to the first end, wherein the second end is threaded;

an upstream disk, wherein the disk has a centric opening that is threaded to mate with the second end of the first diffuser tube and has an external diameter to securely fit within the elongated hollow member;

a second hollow diffuser tube having a first end and a second end and a plurality of openings distal to the first end, wherein a predetermined distance from the first end the internal surface is threaded to mate with the second end of the first hollow diffuser tube; and a wire mesh that is wrapped around the first and second hollow diffuser tubes.

2. The firearm suppressor of claim 1, wherein the wire mesh has a range from one wires per inch to eight hundred wires per inch.

3. The firearm suppressor of claim 1, further comprising:

a third hollow diffuser tube having a first end and a second end and having a plurality of openings distal to the first end, wherein a predetermined distance from the first end towards the second end the internal surface is threaded to mate with the second end of the second hollow diffuser tubes first end and the second end is threaded to mate with the threaded opening of the end cap.

4. The firearm suppressor of claim 1, wherein casing is made from aluminum.

5. The firearm suppressor of claim 1, wherein the plurality of openings on the first hollow diffuser tube are positioned on the surface in a predetermined pattern around a central axis of the first hollow diffuser tube.

6. The firearm suppressor of claim 1, wherein the plurality of openings on the second hollow diffuser tube are positioned on the surface in a predetermined pattern around a central axis of the second hollow diffuser tube.

7. The firearm suppressor of claim 3, wherein the plurality of openings on the third hollow diffuser tube are positioned on the surface in a predetermined pattern around a central axis of the third hollow diffuser tube.

8. A suppressor for firearms, comprising:

a casing, comprising;

a hollow connection member having a first end and a second end, wherein the first end has a first thread opening and the second end has a second threaded opening, a first elongated hollow member having a first end a second end, wherein the first end is thread to mate with the second end of the hollow connection member and the second end has a grooved portion, a second elongated hollow member having a first end and a second end, wherein the first end has a first groove and the second end has a second grove, and an end cap sized having a centric opening that is threaded to mate with the second end of the second hollow diffuser tube and has an external diameter to securely fit within the second end of the elongated hollow member, a first hollow diffuser tube having a first end and a second end and a plurality of openings distal to the first end, wherein the second end is threaded;

an upstream disk, wherein the disk has a centric opening that is threaded to mate with the second end of the first diffuser tube and an external diameter to securely fit within the elongated hollow member;

a second hollow diffuser tube having a first end and a second end and a plurality of openings distal to the first end, wherein a predetermined distance from the first end towards the second end the internal surface is threaded to mate with the second end of the first hollow diffuser tube and a predetermined distance from the second end the external surface is threaded;

a separation disk having a threaded centric opening that is sized to mate with the second hollow diffuser tube and having a first protrusion sized to mate with the groove on the second end of the first elongated hollow member and a second protrusions sized to mate with the groove on the first side of the second elongated hollow member;

a third hollow diffuser tube having a first end and a second end and a plurality of openings distal to the first end, wherein a predetermined distance from the first end towards the second end the internal surface is threaded to mate with the second end of the second hollow diffuser tube; and a wire mesh that is wrapped around the diffuser tubes.

9. The firearm suppressor of claim 8, wherein the wire mesh has a range from one wires per inch to eight hundred wires per inch.

10. The firearm suppressor of claim 8, wherein the hollow diffuser tubes are made from titanium.

11. The firearm suppressor of claim 8, wherein casing is made from aluminum.

12. The firearm suppressor of claim 8, wherein the plurality of openings on the first hollow diffuser tube are positioned on the surface in a predetermined pattern around a central axis of the first hollow diffuser tube.

13. The firearm suppressor of claim 8, wherein the plurality of openings on the second hollow diffuser tube are positioned on the surface in a predetermined pattern around a central axis of the second hollow diffuser tube.

14. The firearm suppressor of claim 8, wherein the plurality of openings on the third hollow diffuser tube are positioned on the surface in a predetermined pattern around a central axis of the third hollow diffuser tube.

15. The firearm suppressor of claim 8, wherein the wire mesh wraps around the hollow diffusers a predetermined number of time, and are of a predetermined length so as to cover the portions of the diffusers that has a plurality of openings on the surfaces.

16. The firearm suppressor of claim 8, wherein the wire mesh is a titanium open cell foam structure sized to fit between the diffuser tubes and the casing.

* * * * *